US009083132B2

(12) United States Patent
Lee

(10) Patent No.: US 9,083,132 B2
(45) **Date of Patent: *Jul. 14, 2015**

(54) NETWORK COMMUNICATION CONNECTOR FABRICATION METHOD

(71) Applicant: RIIDEA International Corp., Apia (WS)

(72) Inventor: Lung-Hsi Lee, New Taipei (TW)

(73) Assignee: RIIDEA INTERNATIONAL CORP., Apia (WS)

( * ) Notice: Subject to any disclaimer, the term of this patent is extended or adjusted under 35 U.S.C. 154(b) by 201 days.

This patent is subject to a terminal disclaimer.

(21) Appl. No.: 13/777,640

(22) Filed: Feb. 26, 2013

(65) Prior Publication Data

US 2013/0227840 A1 Sep. 5, 2013

(30) Foreign Application Priority Data

Mar. 2, 2012 (TW) ..... 101106968 A

(51) Int. Cl.

| | |
|---|---|
| ***H01R 43/048*** | (2006.01) |
| ***H01R 43/00*** | (2006.01) |
| ***H01R 43/16*** | (2006.01) |
| ***H01R 43/24*** | (2006.01) |
| *H01R 24/64* | (2011.01) |

(52) U.S. Cl.

CPC ..... *H01R 43/00* (2013.01); *H01R 43/16* (2013.01); *H01R 43/24* (2013.01); *H01R 24/64* (2013.01); *Y10T 29/49213* (2015.01)

(58) Field of Classification Search

CPC ..... H01R 43/16; H01R 43/24; H01R 43/28; H01R 43/00; H01R 24/64; Y10T 29/49213

USPC ..... 29/874, 882, 883, 884

See application file for complete search history.

(56) References Cited

FOREIGN PATENT DOCUMENTS

CN 102290661 A * 12/2011

* cited by examiner

*Primary Examiner* — Carl Arbes

(74) *Attorney, Agent, or Firm* — Muncy, Geissler, Olds & Lowe, P.C.

(57) ABSTRACT

A network communication connector fabrication method for making network communication connectors is performed by: employing a cold drawing technique to repeatedly draw a metal round rod into a thin thickness conducting contact bar, stamping one end of the thin thickness conducting contact bar into a mating contact portion, stamping the thin thickness conducting contact to form an interference portion and a bonding portion, cutting off the thin thickness conducting contact bar subject to a predetermined length, repeating the above steps to obtain multiple metal contacts, electroplating the metal contacts, setting the metal contacts in two contact material strips and inserting the metal contacts in a mold, and then using an injection molding technique to mold an electrically insulative terminal block on the interference portions of the metal contacts to form a semi-finished product for making a network communication connector.

8 Claims, 12 Drawing Sheets

NETWORK COMMUNICATION CONNECTOR FABRICATION METHOD

This application claims the priority benefit of Taiwan patent application number 101106968, filed on Mar. 2, 2012.

BACKGROUND OF THE INVENTION

1. Field of the Invention

The present invention relates to electrical connector technology and more particularly, to a network communication connector fabrication method, which employs a cold drawing procedure to draw a metal round rod into a conducting contact bar, uses stamping and cutting techniques to make metal contacts, and then employs an injection molding technique to mold electrically insulative terminal blocks on metal contacts so that a large number of semi-finished products are formed rapidly at a time and can be assembled with a respective electrically insulative housing, a respective electric circuit module and a respective metal shield to form a respective network communication connector.

2. Description of the Related Art

With fast development of computer technology, in addition to the functions of basic computing, word processing, diagram or photograph or image editing and modification, people can use computer technology to search data, inquire information, or hold a video meeting around the world via the internet, providing incredible convenience at study, family life or work. Nowadays, the Internet has become an indispensable part of our lives. For transmitting a signal from a host computer to the Internet, network communication connectors, for example, RJ45 connectors are commonly used. The metal contacts of RJ45 connectors are generally made out of electroplated copper wire rods. These electroplated copper wire rods are individually inserted into an insulative terminal block member, and then properly cut subject to a predetermined length, and processed or stamped to provide respective mating contact portions and bonding portions and then bent into a predetermined shape, and then assembled with other component parts to form a network communication connector. This conventional network communication connector fabrication method has drawbacks as follows:

1. Because the copper wire rods are processed or stamped to provide respective mating contact portions and bonding portions and then bent into a predetermined shape after electroplated, the metal coating may easily be damaged during the stamping and bending procedures, lowering the yield rate.
2. When inserting the electroplated copper wire rods into an insulative terminal block member, the electroplated copper wire rods must be kept perpendicular to the insulative terminal block member, and the electroplated copper wire rods may easily be curved or deformed during insertion. Further, it is difficult to accurately control the insertion depth. If the electroplated copper wire rods are not kept in perfect alignment after insertion into the insulative terminal block member, they must be adjusted, wasting much labor and time.

Therefore, it is desirable to provide a method for making network communication connectors that eliminates the aforesaid problems.

SUMMARY OF THE INVENTION

The present invention has been accomplished under the circumstances in view. It is therefore the main object of the present invention to provide a network communication connector fabrication method, which greatly improves network communication connector fabrication efficiency, shortens network communication connector fabrication time, increases network communication connector yield rate, and reduces network communication connector manufacturing cost.

To achieve this and other objects of the present invention a network communication connector fabrication method comprises the steps of: employing a cold drawing technique with the use of a series of dies having different diameters of drawing holes to repeatedly draw a metal round rod into a thin thickness conducting contact bar, and then stamping one end of the thin thickness conducting contact bar into a mating contact portion, and then stamping the thin thickness conducting contact to form an interference portion and a bonding portion, and then cutting off the thin thickness conducting contact bar subject to a predetermined length, and then repeating the above steps to obtain multiple metal contacts, and then electroplating the metal contacts, and then setting the metal contacts in two vertically spaced contact material strips to keep the metal contacts in two vertically spaced rows in a staggered manner, and then using an injection molding technique to mold an electrically insulative terminal block on the interference portions of the metal contacts to form a semi-finished product, and then removing the contact material strips from the metal contacts for enabling the semi-finished product to be assembled with an electrically insulative housing, an electric circuit module and a metal shield to form a network communication connector.

Further, by means of repeating the cold drawing process, stamping process and cutting process, multiple metal contacts can be rapidly obtained and then respective set in respective locating notches of contact material strips to receive further electroplating and molding processes.

Further, multiple contact material strips can be used to hold a large amount of metal contacts in multiple sets, and these multiple sets of metal contacts can be set in respective cavities of one or a number of molds, enabling a respective electrically insulative terminal block to be respectively molded on the interference portions of each set of metal contacts, and thus, the network communication connector manufacturing process can be greatly shortened, lowering the cost.

DETAILED DESCRIPTION OF THE PREFERRED EMBODIMENT

Figure 1:
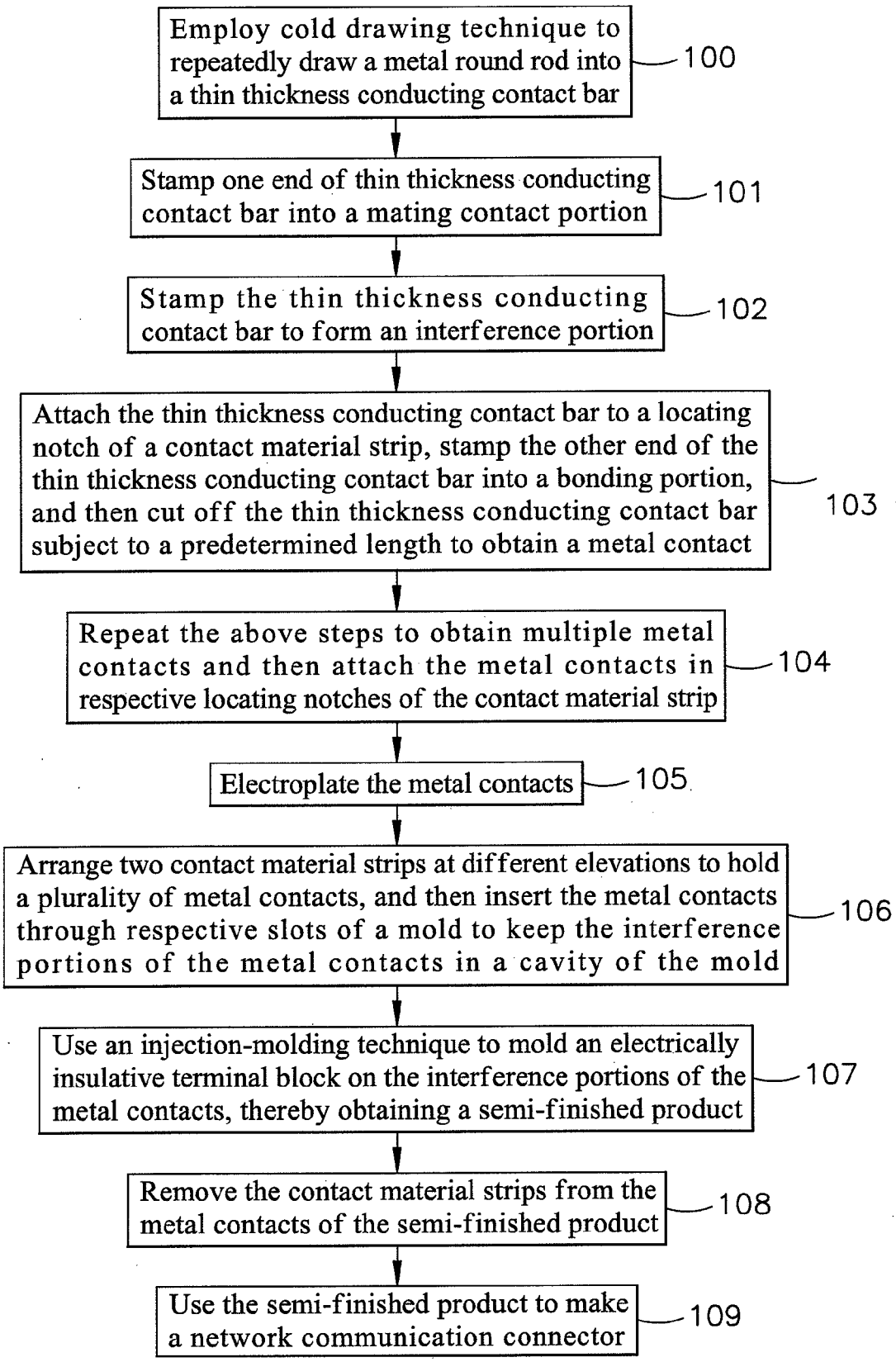
FIG. 1 is a flow chart of a network communication connector fabrication method in accordance with the present invention.
Figure 2:
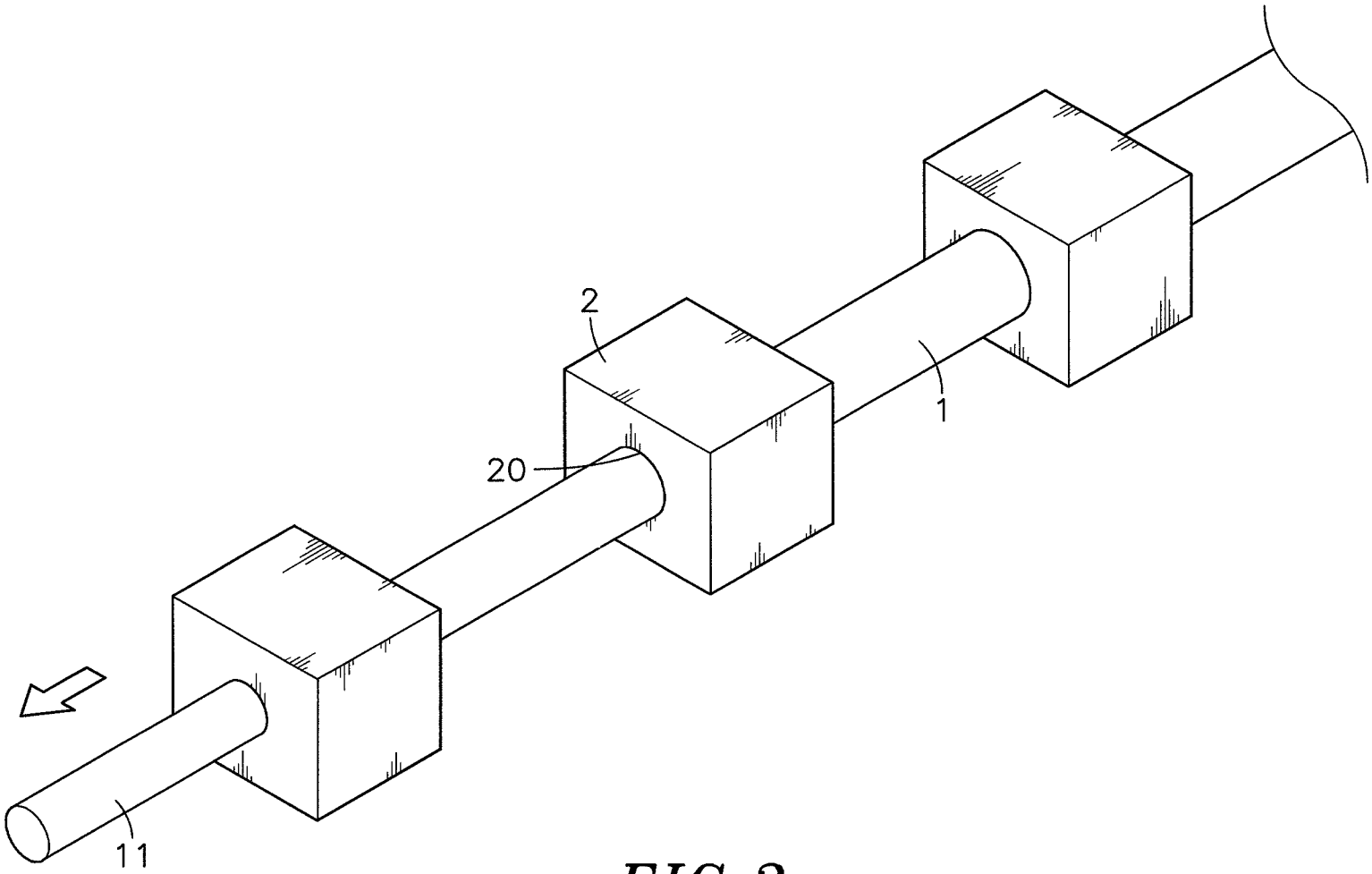
FIG. 2 is a schematic drawing illustrating the performance of a cold drawing step of the network communication connector fabrication method in accordance with the present invention.
Figure 3:
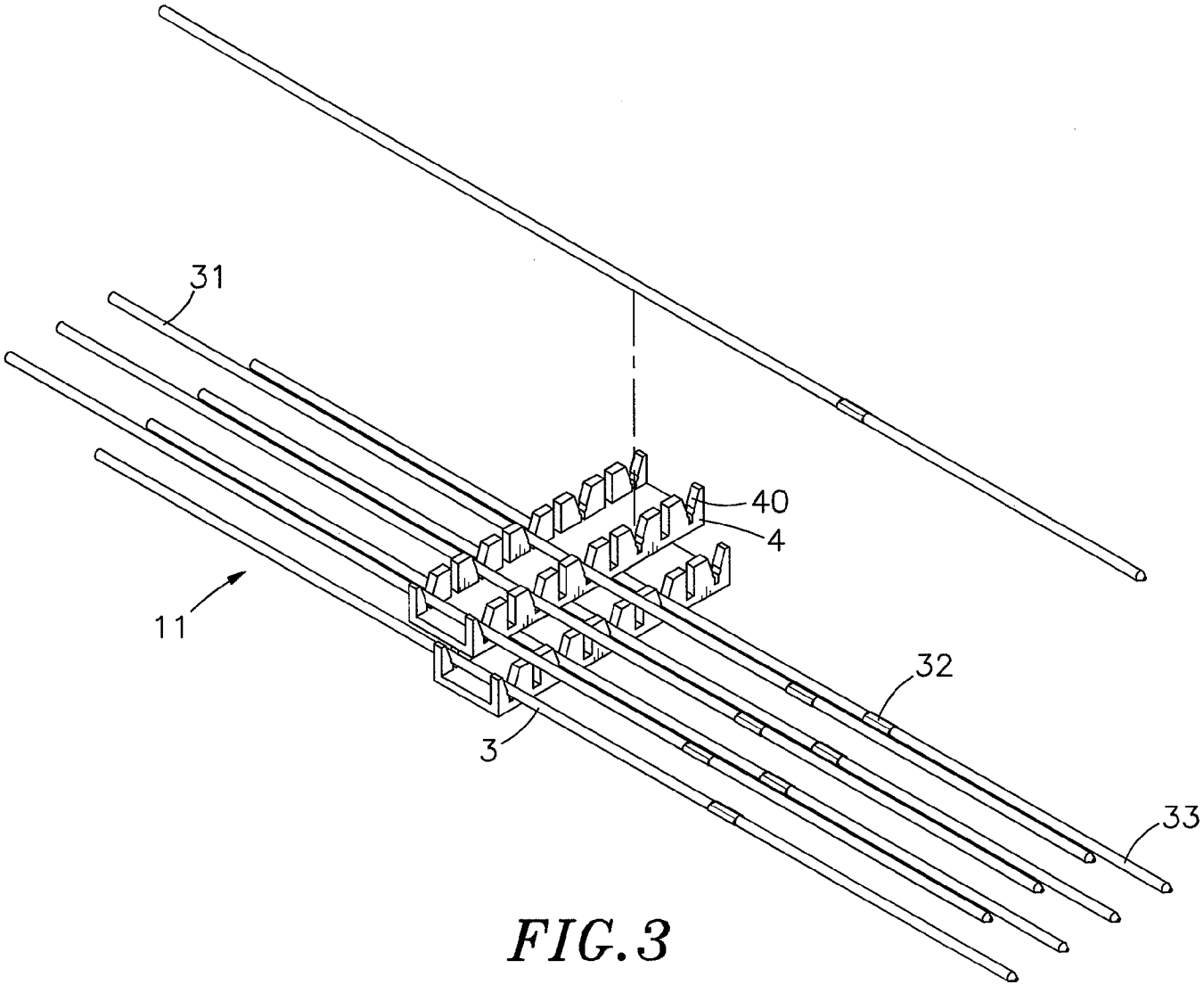
FIG. 3 is a schematic drawing illustrating installation of metal contacts in a contact material strip during the application of the network communication connector fabrication method in accordance with the present invention.
Figure 4:
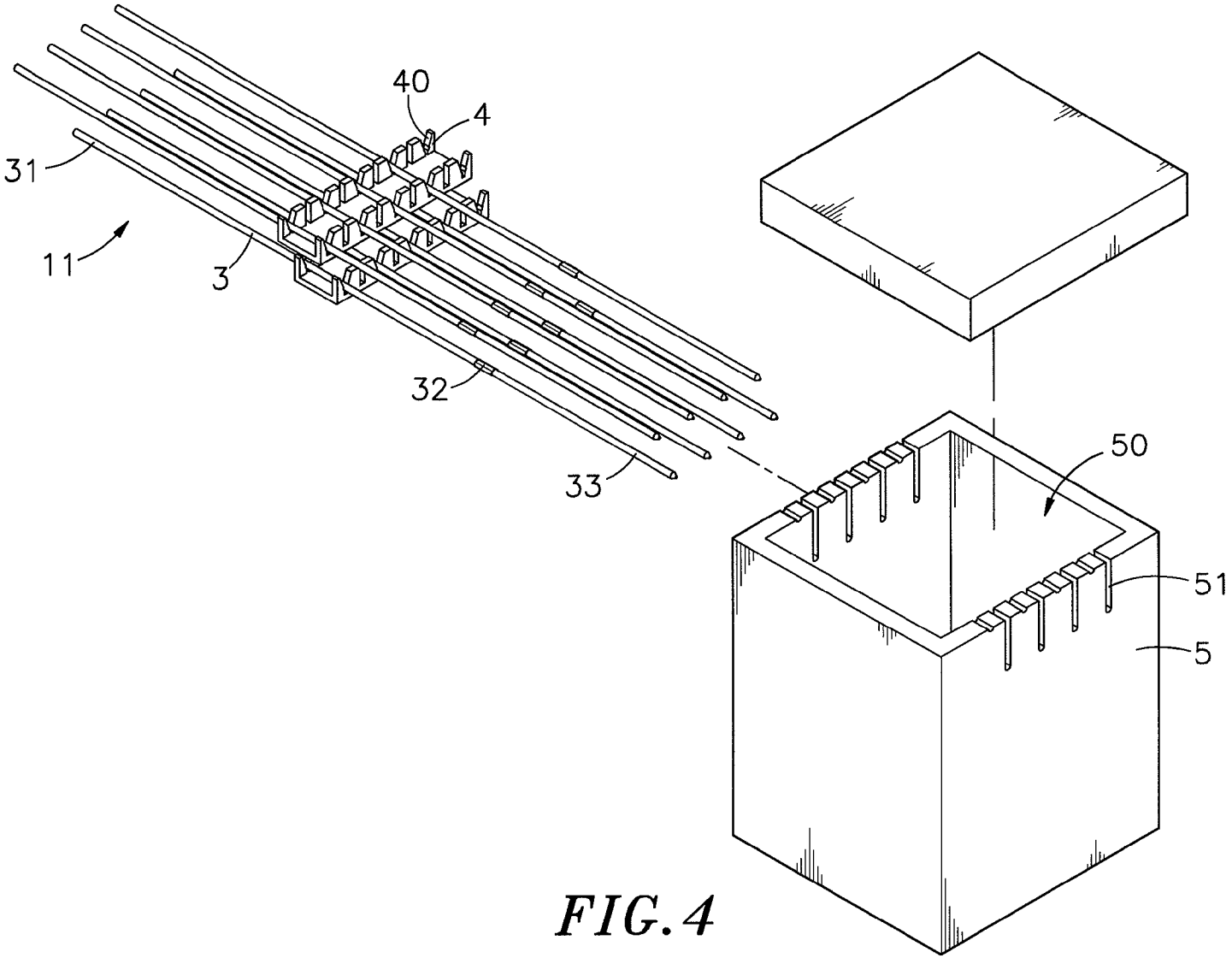
FIG. 4 is a schematic drawing illustrating the metal contacts held in the contact material strips and aimed at respective slots of the mold during the application of the network communication connector fabrication method in accordance with the present invention.
Figure 5:
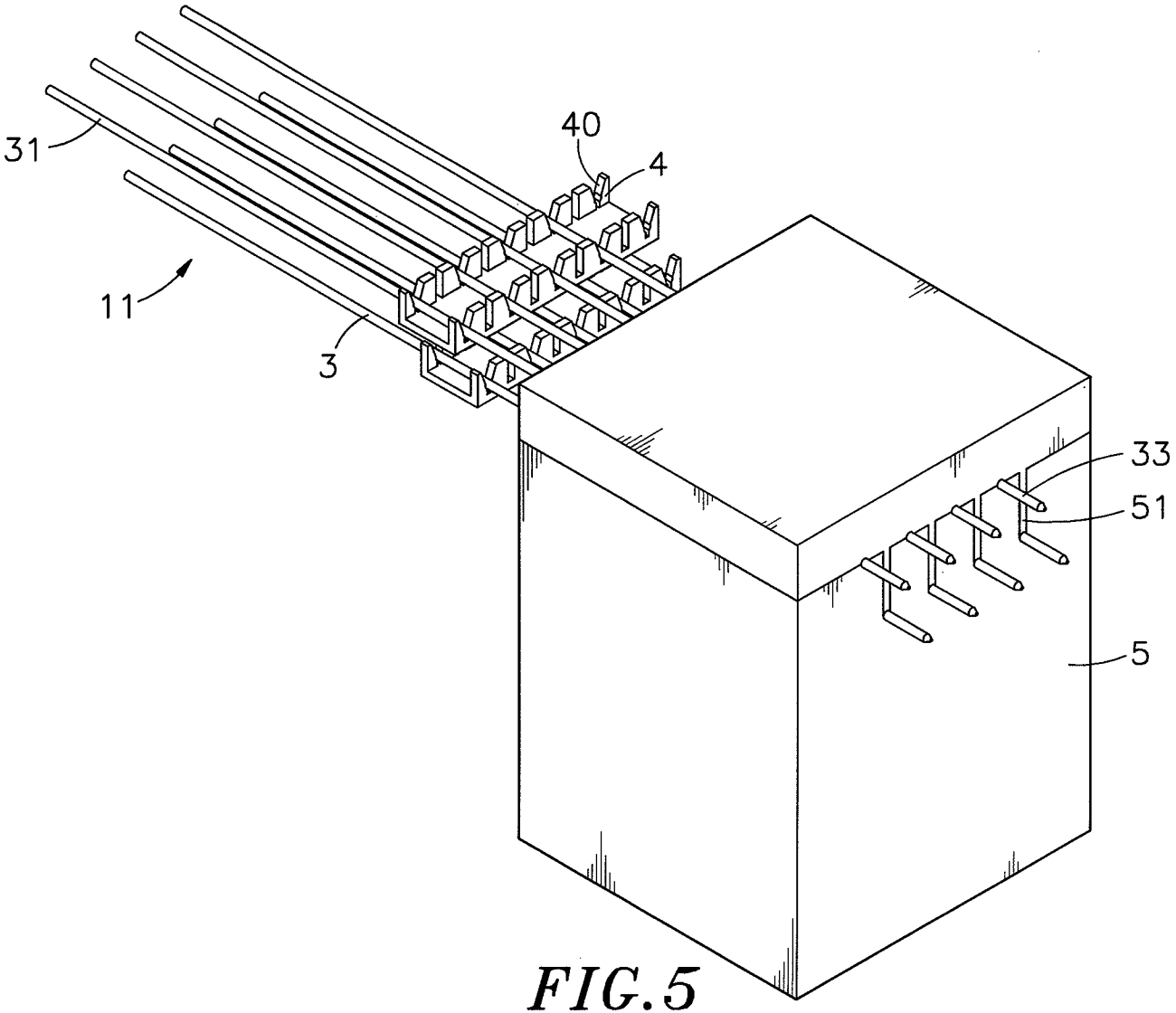
FIG. 5 corresponds to FIG. 4, illustrating the metal contacts set in the mold and the mold closed.
Figure 6:
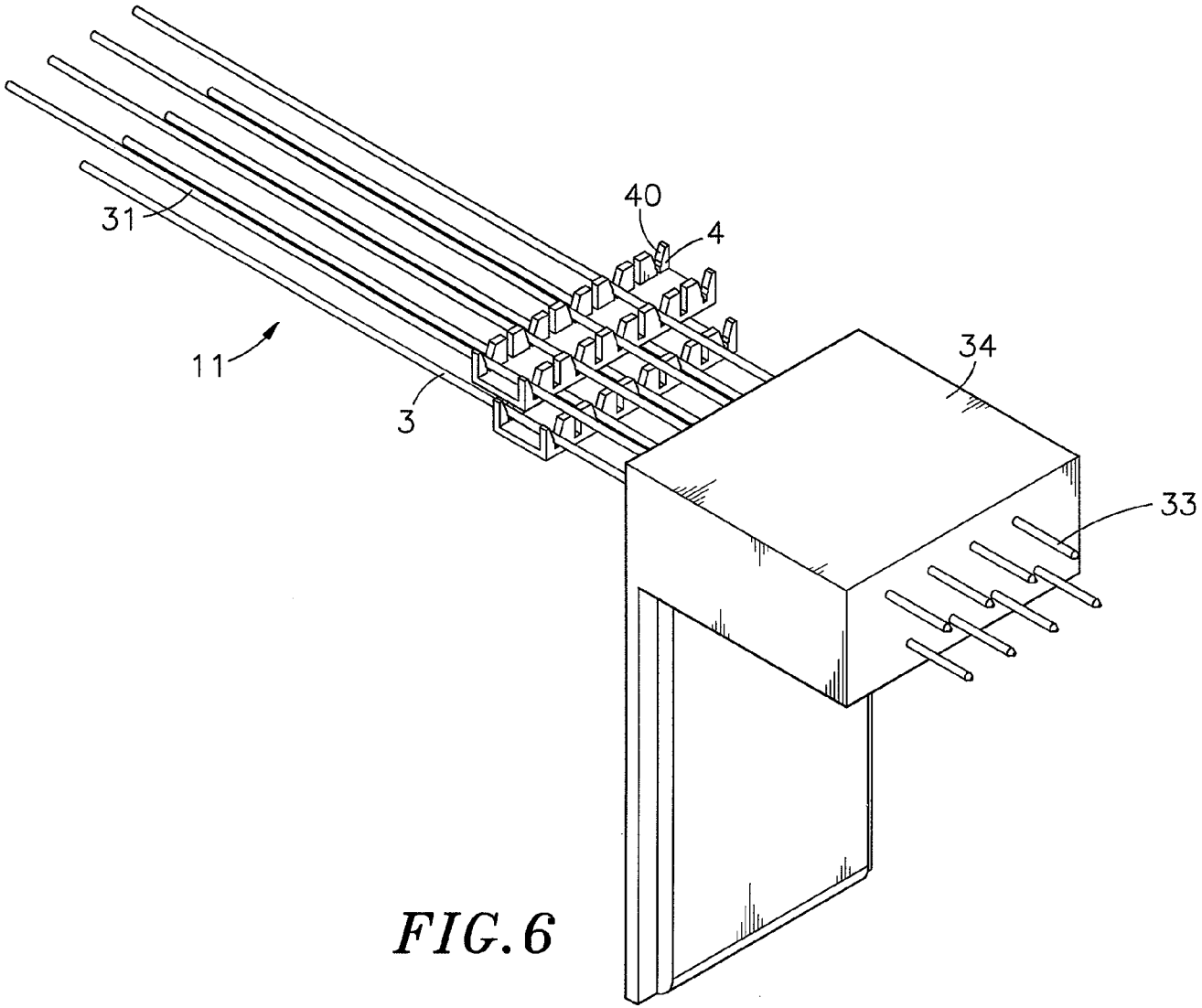
FIG. 6 is an elevational view of a semi-finished product made according to the present invention before removal of the contact material strips.
Figure 9:
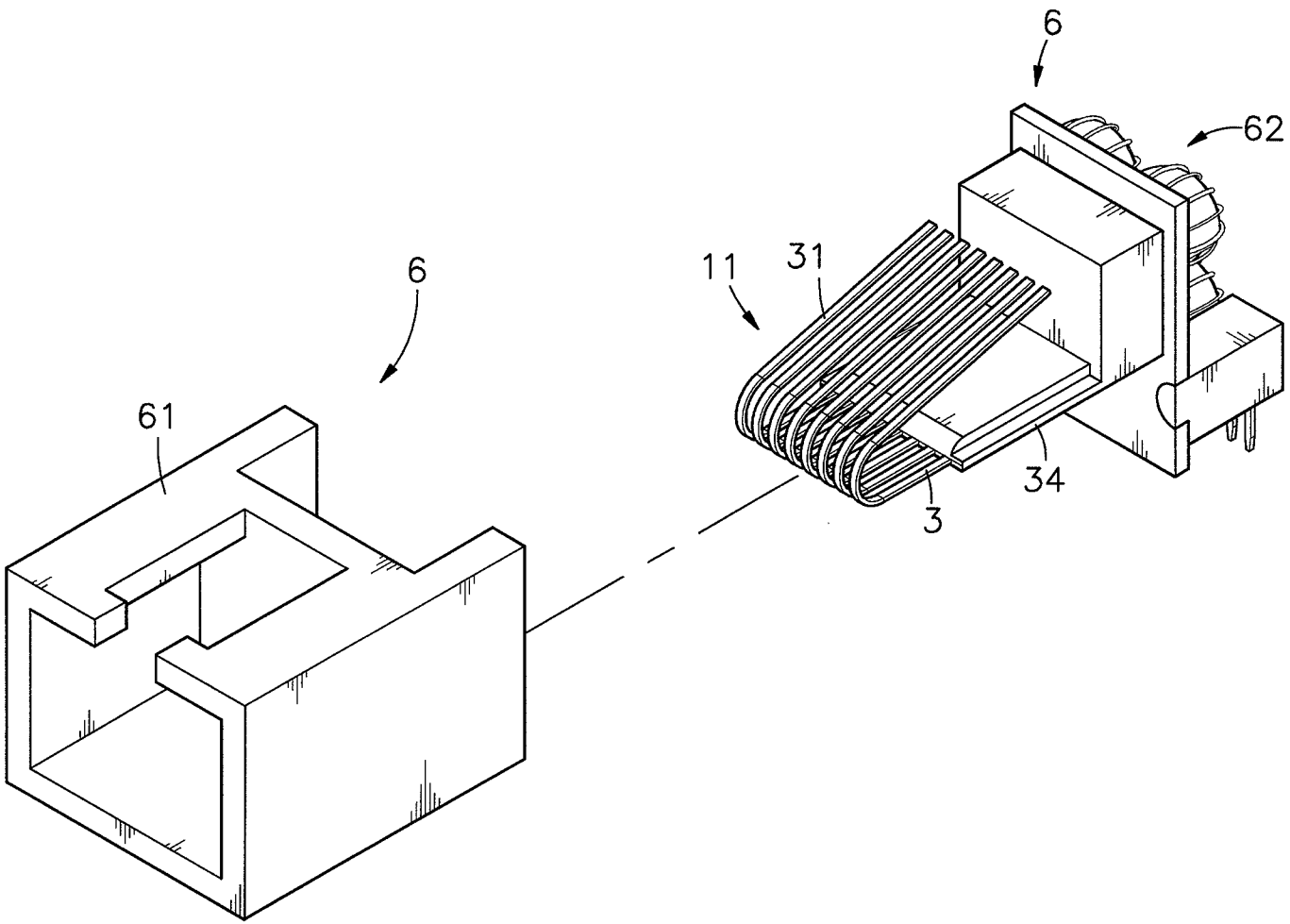
FIG. 9 is an exploded view of a network communication connector constructed in accordance with the present invention.
Figure 10:
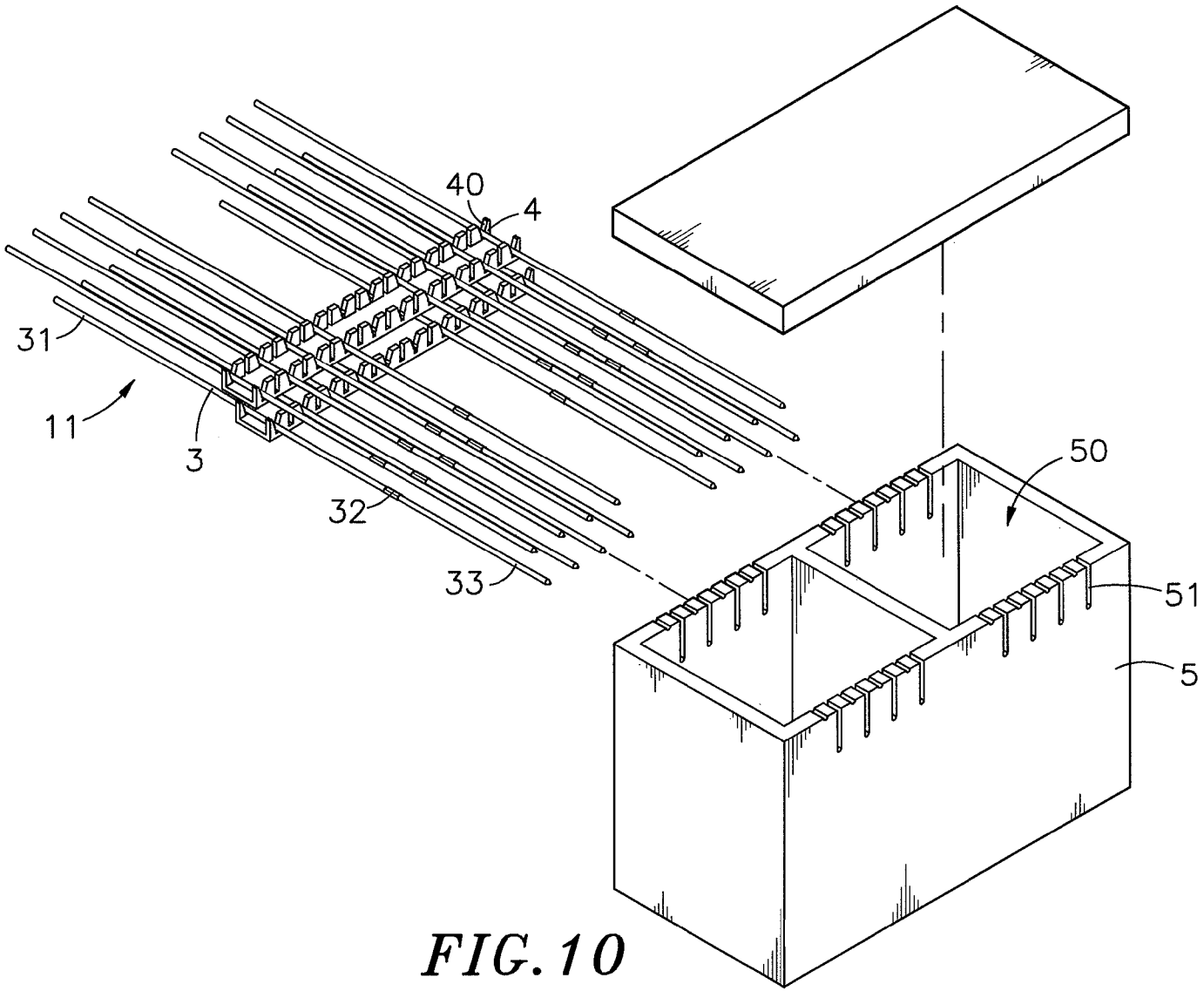
FIG. 10 is a schematic exploded view illustrating multiple metal contacts arranged in two vertically spaced contact material strips in two sets and respectively aimed at respective slots of a mold in accordance with the present invention.
Figure 11:
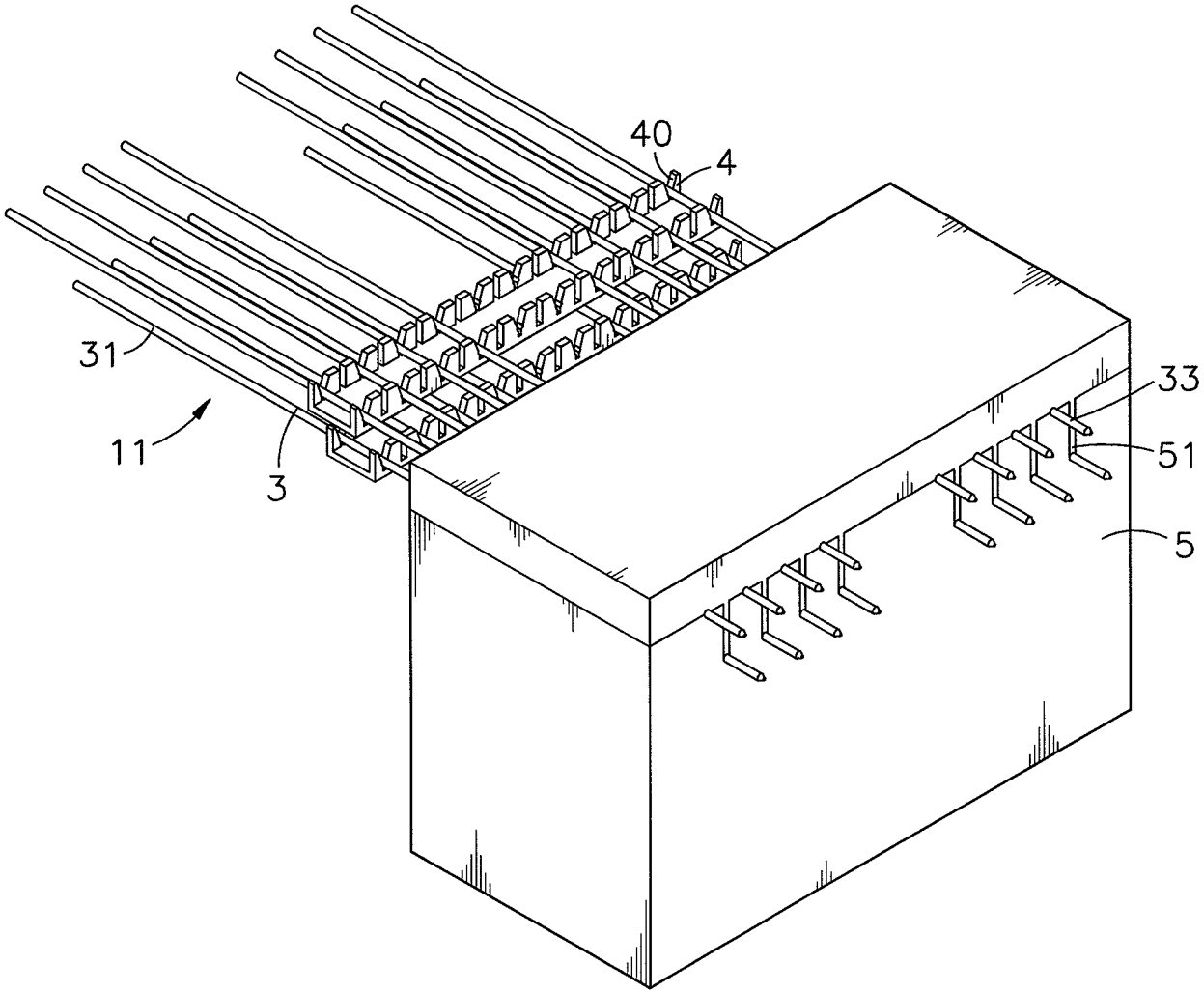
FIG. 11 corresponds to FIG. 10, illustrating the metal contacts set in the cavity of the mold and the mold closed.
Figure 12:
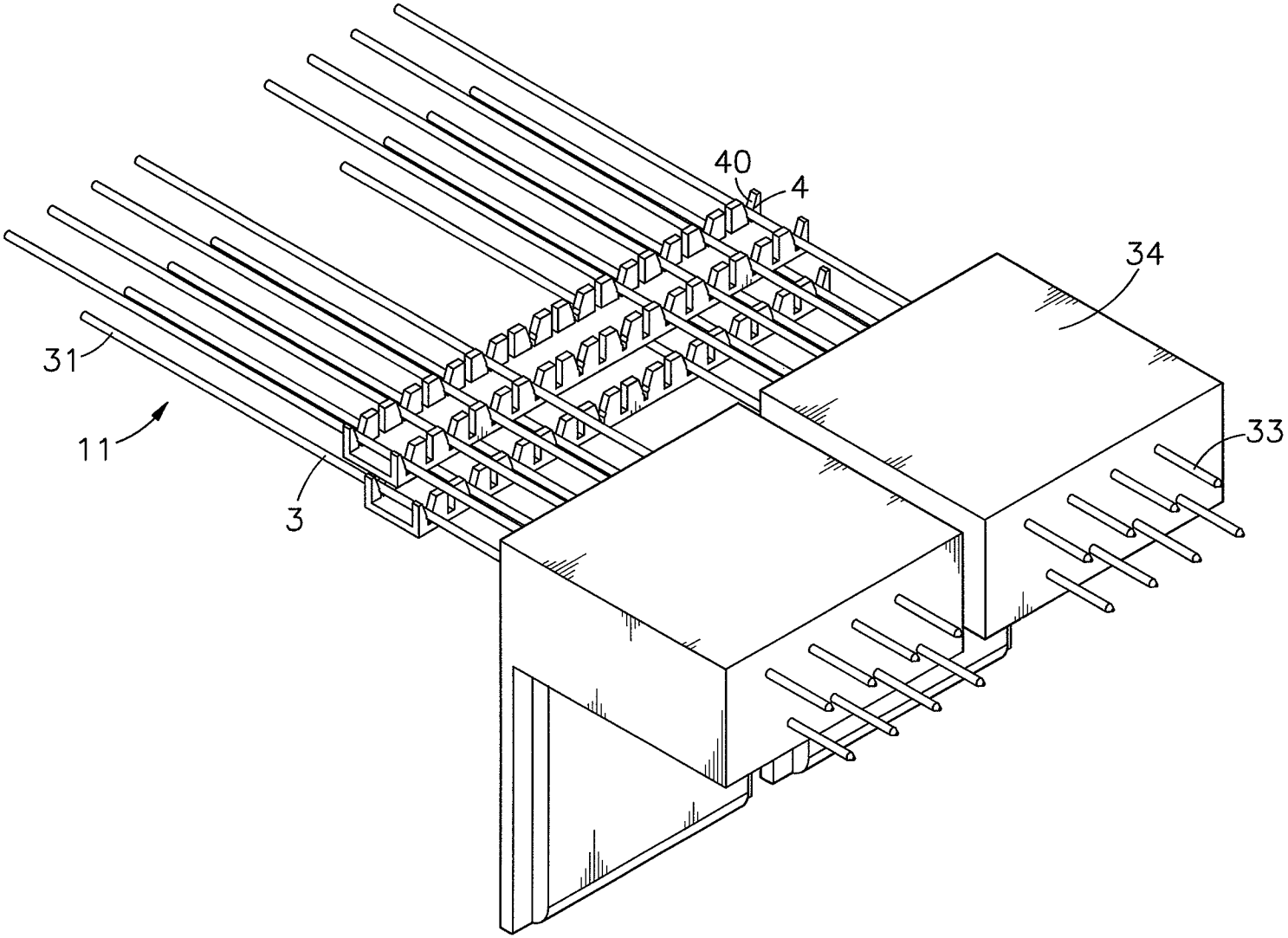
FIG. 12 illustrates two electrically insulative terminal blocks respectively formed on the two sets of metal contacts before removal of the contact material strips.

Referring to FIGS. 1-6, a method for fabricating a network communication connector in accordance with a first embodiment of the present invention is shown comprising the steps of:

(100) employing a cold drawing technique with a series of dies 2 having different diameters of drawing holes 20 to repeatedly draw a metal round rod 1 into a thin thickness conducting contact bar 11;

(101) stamping one end of the thin thickness conducting contact bar 11 into a mating contact portion 31;

(102) stamping a part of the thin thickness conducting contact bar 11 between the two opposite ends thereof to form an interference portion 32 having multiple ribs around the periphery thereof;

(103) attaching the thin thickness conducting contact bar 11 to a locating notch 40 of a contact material strip 4 that has a U-shaped cross section with each locating notch located at the two parallel upright sidewalls of the U-shaped cross section, and then stamping the other end of the thin thickness conducting contact bar 11 into a bonding portion 33, and then cutting off the thin thickness conducting contact bar 11 subject to a predetermined length to obtain a finished metal contact 3;

(104) repeating steps (100)(103) to obtain a plurality of metal contacts 3 and then putting these metal contacts 3 in respective locating notches 40 of contact material strips 4;

(105) electroplating the metal contacts 3 at the contact material strips 4 partially or locally;

(106) arranging two contact material strips 4 at different elevations to hold a plurality of metal contacts 3 in a set where the metal contacts 3 are held in two vertically spaced rows in a staggered manner, and then inserting the metal contacts 3 through respective slots 51 of a mold 5 to keep the interference portions 32 of the metal contacts 3 in a cavity 50 of the mold 5;

(107) injection-molding an electrically insulative terminal block 34 on the interference portions 32 of the metal contacts 3 in the cavity 50 of the mold 5 to form a semi-finished product, and then removing the mold 5 from the semi-finished product;

(108) removing the contact material strips 4 from the metal contacts 3, and then forming the mating contact portion and the bonding portion into a predetermined shape;

(109) using the shaped semi-finished product to make a network communication connector 6 (see FIG. 9).

In the aforesaid steps (100)~(103), a metal round rod 1 is processed into a thin thickness conducting contact bar 11 using a cold drawing technique, and then the metal round rod 1 is stamped to form a mating contact portion 31 and an interference portion 32. Thereafter, repeat the aforesaid steps (100)~(103) to obtain multiple metal contacts 3. These metal contacts 3 are then put in respective locating notches 40 of the contact material strips 4.

Further, by means of employing a cold drawing technique, the metal round rod 1 can be processed into a thin thickness conducting contact bar 11 having a circular, rectangular or oval cross section.

Further, using a cold drawing technique to draw the metal round rod 1 into a thin thickness conducting contact bar 11 for making a metal contact 3 can reduce waste material and enhance the structural strength of the metal contact 3. Further, the design of the interference portion 32 enhances bond-tightness between the electrically insulative terminal block 34 and the metal contact 3, improving the structural strength and facilitating further processing. Further, when molding the electrically insulative terminal block 34 on the metal contact 3, the metal contacts 3 are held in the respective locating notches 40 of two contact material strips 4, avoiding deviation, biasing or deformation, and therefore, the invention greatly increases the yield rate of the semi-finished product and effectively reduces the manufacturing cost of the semi-finished product.

Figure 7:
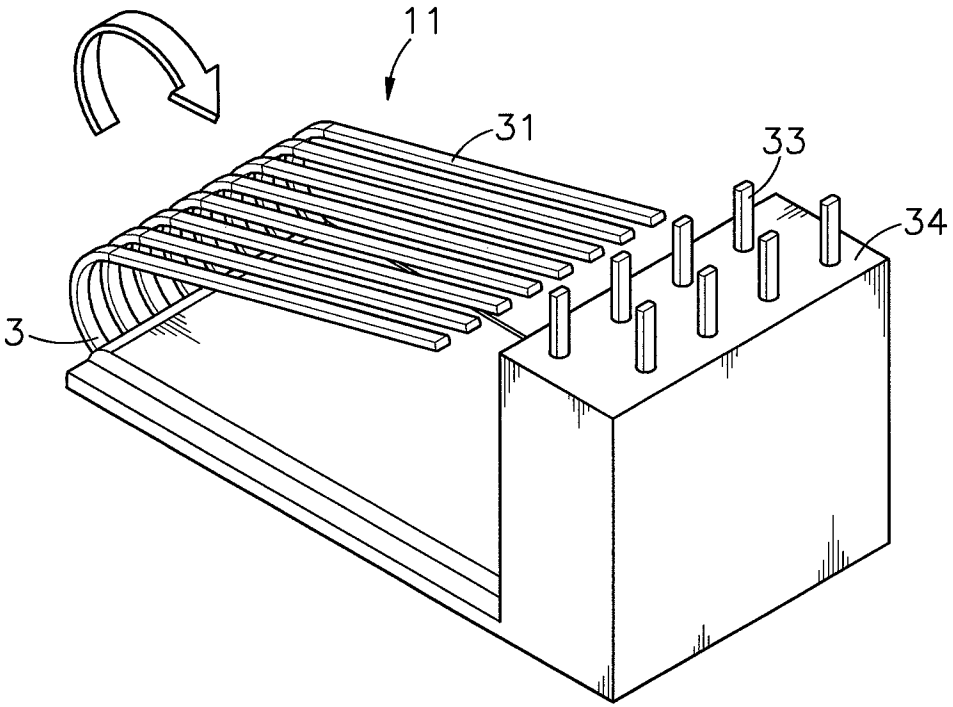
FIG. 7 is a schematic drawing illustrating the mating contact portions of the metal contacts of the semi-finished product bent into a predetermined shape after removal of the contact material strips in accordance with the present invention.
Figure 8:
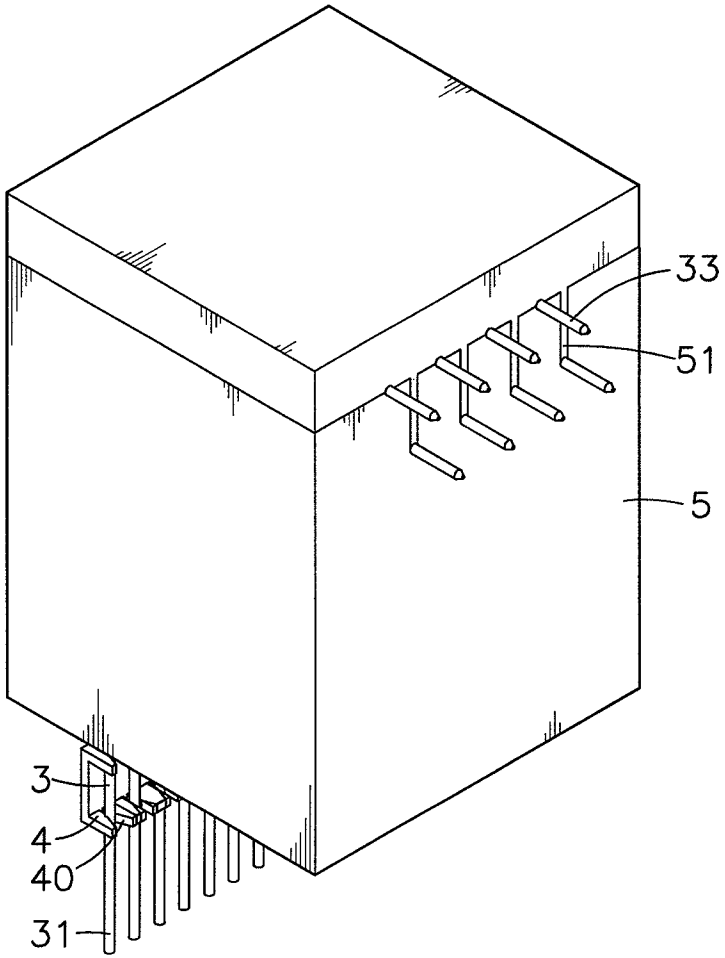
FIG. 8 is a schematic drawing illustrating that the metal contacts with the mating contact portions bent are held in the contact material strips and inserted into the mold.

During steps (106)~(108), the metal contacts 3 are held in the contact material strips 4 and inserted through respective slots 51 of the mold 5, and then an electrically insulative terminal block 34 is molded on the interference portions 32 of the metal contacts 3 in the cavity 50 of the mold 5 to form a semi-finished product. Further, the mating contact portions 31 of the metal contacts 3 are bent into a predetermined shape after molding of the electrically insulative terminal block 34 (see FIGS. 7 and 8). Alternatively, the mating contact portions 31 of the metal contacts 33 are bent into a predetermined shape before the molding process.

In the aforesaid step (109), the shaped semi-finished product is used to make a network communication connector 6 (see FIG. 9), where the semi-finished product of the metal contacts 3 and the electrically insulative terminal block 34 is assembled with an electrically insulative housing 61, an electric circuit module 62 and a metal shield (not shown) to form a network communication connector 6 (for example, RJ45 connector).

In the aforesaid step (108), the mating contact portions 31 of the metal contacts 3 are bent into a predetermined shape after removal the contact material strips 4 from the metal contacts 3, and then bending. Further, the mating contact portions 31 of the metal contacts 3 can be configured in the shape of a round rod or flat rod. Further, the bonding portions 33 of the metal contacts 3 can be configured in the shape of a flat rod (for surface mount technology), round rod, pyramidal prism or conical prism.

Further, the aforesaid step (102) of stamping a part of the thin thickness conducting contact bar 11 between the two opposite ends thereof to form an interference portion 32 can be omitted, i.e., the metal contacts 3 can be prepared without the interference portions 32, and the electrically insulative terminal block 34 can be directly molded on the plain surfaces of the metal contacts 3.

Referring to FIGS. 9-12, after preparation of a large amount of the metal contacts 3, the metal contacts 3 can then be put in respective locating notches 40 of at least two vertically spaced contact material strips 4 and arranged in multiple sets, and then the metal contacts 3 are inserted through respective slots 51 of one or multiple molds 5, and then a respective electrically insulative terminal block 34 is molded on each set of metal contacts 3 in one respective cavity 50 of the mold(s) 5 to form one respective semi-finished product. Thus, multiple semi-finished products can be made at a time.

When multiple semi-finished products are obtained, they are respectively assembled with a respective electrically insulative housing 61, a respective electric circuit module 62 and a respective metal shield (not shown) to form a respective network communication connector 6 (for example, RJ45 connector).

As stated above, the invention provides a network communication connector fabrication method for making network communication connectors by: employing a cold drawing technique with the use of a series of dies 2 having different diameters of drawing holes 20 to repeatedly draw a metal round rod 1 into a thin thickness conducting contact bar 11, stamping one end of the thin thickness conducting contact bar 11 into a mating contact portion 31, stamping the thin thickness conducting contact 11 to form an interference portion 32 and a bonding portion 31, cutting off the thin thickness conducting contact bar 11 subject to the desired length to obtain a finished metal contact 3, repeating the aforesaid procedure to obtain a large amount of metal contacts 3, attaching the metal contacts 3 to respective locating notches 40 of each two vertically arranged contact material strips 4 in one set or multiple sets, and then using an injection molding technique to mold an electrically insulative terminal block 34 on each set of metal contacts 3 in one respective cavity 50 of one or multiple mold(s) 5 to form one respective semi-finished product. Each semi-finished product is then assembled with an electrically insulative housing 61, an electric circuit module 62 and a metal shield to form a respective network communication connector 6.

In conclusion, the invention provides a network communication connector fabrication method for making network communication connectors, which has the advantages and features as follows:

1. When molding an electrically insulative terminal block 34 on the interference portions 32 of the metal contacts 3 in a cavity 50 of a mold 5, the metal contacts 3 are held in the respective locating notches 40 of two contact material strips 4, avoiding deviation, biasing or deformation, and therefore, the invention greatly increases the yield rate of the semi-finished product and effectively reduces the manufacturing cost of the semi-finished product.
2. An electrically insulative terminal block 34 is directly molded on the interference portions 32 of one set of metal contacts 3 in a cavity 50 of a mold 5, eliminating the problem of individual metal contact insertion operation and avoiding curving or deformation of the metal contacts 3 during the molding operation.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A network communication connector fabrication method, comprising the steps of:

(a) employing a cold drawing technique to repeatedly draw a metal round rod into a thin thickness conducting contact bar;
(b) stamping one end of said thin thickness conducting contact bar into a mating contact portion;
(c) stamping a part of said thin thickness conducting contact bar between two opposite ends thereof to form an interference portion;
(d) attaching said thin thickness conducting contact bar to one respective locating notch of a contact material strip and then stamping the other end of said thin thickness conducting contact bar into a bonding portion, and then cutting off said thin thickness conducting contact bar subject to a predetermined length to obtain a finished metal contact;
(e) attaching multiple said metal contacts in respective locating notches of said contact material strip;
(f) electroplating said metal contacts at the contact material strips;
(g) arranging two said contact material strips at different elevations to hold a plurality of said metal contacts, and then inserting said metal contacts through respective slots of a mold to keep the interference portions of said metal contacts in a cavity of said mold;
(h) injection-molding an electrically insulative terminal block on the interference portions of said metal contacts to form a semi-finished product, and then removing said mold from said semi-finished product;
(i) removing said contact material strips from said metal contacts, and then forming the mating contact portion and the bonding portion of said metal contacts into a predetermined shape; and
(j) using the shaped semi-finished product to make a network communication connector.

2. The network communication connector fabrication method as claimed in claim 1, wherein in step (a), said metal round rod is drawn into a thin thickness conducting contact bar having a circular, rectangular or oval cross section.

3. The network communication connector fabrication method as claimed in claim 1, wherein in step (c), a part of said thin thickness conducting contact bar is stamped to form an interference portion having multiple ribs around the periphery thereof.

4. The network communication connector fabrication method as claimed in claim 1, wherein in step (d), said multiple metal contacts are obtained by repeating steps (a)~(d).

5. The network communication connector fabrication method as claimed in claim 1, wherein in step (f), electroplating said metal contacts is performed using one of dip electroplating and brush electroplating techniques.

6. The network communication connector fabrication method as claimed in claim 1, wherein during steps (g), (h) and (i), said metal contacts are held in said contact material strips in multiple sets, each set of said metal contacts being kept in two vertically spaced rows in a staggered manner.

7. The network communication connector fabrication method as claimed in claim 1, wherein in step (j), said semi-finished product is assembled with an electrically insulative housing, an electric circuit module and a metal shield to form a network communication connector.

8. The network communication connector fabrication method as claimed in claim 1, further comprising a sub step of bending the mating contact portions into a predetermined shape after step (i).

* * * * *